US007340193B2

(12) United States Patent
Tajima

(10) Patent No.: US 7,340,193 B2
(45) Date of Patent: Mar. 4, 2008

(54) IMAGE FORMING APPARATUS, AND STORAGE MEDIUM STORING A CONTROL PROGRAM FOR THE SAME

(75) Inventor: Shinichi Tajima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 161 days.

(21) Appl. No.: 11/164,854

(22) Filed: Dec. 8, 2005

(65) Prior Publication Data

US 2006/0198651 A1 Sep. 7, 2006

(30) Foreign Application Priority Data

Dec. 8, 2004 (JP) ..... 2004-355317

(51) Int. Cl.
*G03G 15/00* (2006.01)
*G03G 15/20* (2006.01)

(52) U.S. Cl. ..... 399/69; 399/70; 399/88

(58) Field of Classification Search ..... 399/69, 399/70, 67, 88, 37, 33; 219/216; 347/156
See application file for complete search history.

(56) References Cited

U.S. PATENT DOCUMENTS 6,842,592 B2 * 1/2005 Kinoshita ..... 399/69
2005/0063724 A1 * 3/2005 Kodama ..... 399/67
2005/0158067 A1 * 7/2005 Kim et al. ..... 399/70
2005/0211692 A1 * 9/2005 Maitani ..... 219/216

FOREIGN PATENT DOCUMENTS

JP 10/133465 A 5/1998
JP 10-133465 A * 5/1998
JP 2000/278469 A 10/2000
JP 2005-044031 A * 2/2005

* cited by examiner

*Primary Examiner*—Sophia S. Chen
(74) *Attorney, Agent, or Firm*—Global IP Counselors, LLP

(57) ABSTRACT

An image forming apparatus is disclosed which interrupts the power supply to the sensors that are used during image formation when it is impossible to form an image, thereby allowing the image forming apparatus so save energy more effectively. The image forming apparatus controls the power supply to sensors that are used during image formation, other than a heating temperature sensor and fixation control sensors, such that the image forming apparatus interrupts the power supply when switched to the non-fixation operation control state, and supplies power when switched to the fixation operation control state and the temperature detected by the heating temperature sensor is equal to or greater than a predetermined temperature near the fixation temperature.

5 Claims, 3 Drawing Sheets

IMAGE FORMING APPARATUS, AND STORAGE MEDIUM STORING A CONTROL PROGRAM FOR THE SAME

BACKGROUND OF THE INVENTION

1. Field of the Invention

The present invention relates to an image forming apparatus such as a printer and a facsimile machine, and particularly to an image forming apparatus having an energy-saving function to control the power supply to each of the components in the apparatus. In addition, the present invention relates to a storage medium that stores a control program for controlling this type of image forming apparatus.

2. Background Information

Recently, electrical appliance manufacturers have been proposing and developing various energy-saving products in order to address environmental protection and energy resource issues. For example, some products have a function which shifts the apparatus to a "standby" state if external input has not been actuated for a certain period of time, so as to reduce power consumption during standby and thereby save energy.

Energy saving methods mentioned above have also been very popular among image forming apparatuses such as printers and copying machines.

A conventional image forming apparatus includes various sensors used to detect the condition of the image forming apparatus so as to determine whether or not it is ready to form images, such as a toner sensor for detecting the remaining amount of developer or toner, a sensor for detecting the remaining number of recording sheets, and a jam or accumulation sensor for detecting a jam of the recording sheets. In addition, the image forming apparatus includes various sensors that are used during image forming operations, such as a registration sensor for detecting the position of one or more recording sheets during image forming operations, and a recording media discharge sensor provided adjacent to a discharge unit to which the recording sheets are discharged out of the apparatus and which detects the discharge state of the recording sheets.

In this conventional image forming apparatus, in order to effectively realize energy savings, the power supply is interrupted to different sensors in different states, such as during image formation, and in the standby state in which the sensor is not used. For example, in the standby state, the power supply is interrupted to the registration sensor and the recording media discharge sensor, which are used only during image formation.

For example, Japanese Unexamined Patent Application Publication No. 2000-278469 discloses a color electrophotographic apparatus wherein the power supply from a power source is interrupted to a toner presence detection sensor which serves to detect toner in a developer tank, or to a sheet sensor which serves to detect the remaining amount of recording sheets, while in a power-saving mode in order to save energy.

Japanese Unexamined Patent Application Publication No. H10-133465 discloses a sensor control device and sensor control method wherein the power supply is controlled so as to de-energize sensors or energize the sensors with a low current in accordance with changes to the apparatus state, such as the standby state, low power consumption mode, and an operation state, and such that the sensors can readily come back to their normal state.

However, even if the apparatus is switched from the power-saving state to image formation state, and, for example, if the temperature of a heat fixing device in the apparatus does not reach the temperature needed to fix a toner image onto a recording sheet, it is impossible to immediately start image formation.

However, in the technologies disclosed in Japanese Unexamined Patent Application Publication No. 2000-278469 and Japanese Unexamined Patent Application Publication No. H10-133465, when the power-saving state, such as a standby state and a low power consumption mode, is cancelled, power supply is quickly resumed to the sensors to which the power supply has been stopped. Consequently, power is supplied to the sensors in vain from the instant that the mode is cancelled to the instant that the apparatus is able to form an image.

Accordingly, in light of this situation, an object of the present invention is to interrupt the power supply to the sensors that are used during image formation when it is impossible to form an image, thereby providing an image forming apparatus that can save energy more effectively.

SUMMARY OF THE INVENTION

An image forming apparatus according to the present invention comprises a heating means which fixes a toner image formed on a recording medium; a heating temperature sensor which detects the temperature of the heating means; a fixation control means which switches between (a) a fixation operation control state in which the heating means is controlled such that the temperature detected by the heating temperature sensor is maintained at a temperature needed to fix the toner image to the recording medium, and (b) a non-fixation operation control state different from the fixation operation control state, in accordance with results detected by one or more fixation control sensors; and a sensor power control means which controls power supplied to sensors, other than the one or more fixation control sensors and the heating temperature sensor, that are used during image formation, such that the power supply is interrupted when the heating means is switched to the non-fixation operation control state by the fixation control means, and the power is supplied when the heating means is switched to the fixation operation control state by the fixation control means and the temperature detected by the heating temperature sensor is equal to or greater than a predetermined temperature near the fixation temperature.

In this structure, even if the image forming apparatus is switched from the non-fixation operation control state to the fixation operation control state, if the fixation temperature has not been obtained by the heater and it is impossible to form an image, the interruption of the power supply to the sensors that are used during image formation is maintained. Consequently, the apparatus according to the present invention achieves more effective energy-saving control compared to the conventional technology, wherein power is supplied to each of the sensors if the apparatus is switched to the fixation operation control state, regardless of whether or not it is possible to form an image.

Preferably, the fixation control sensor includes at least one sensor selected from the group consisting of (a) a sensor for detecting the amount toner remaining, (b) a sensor for detecting the number of recording media remaining, and (c) a recording media jam sensor provided along a recording media conveyance path which serves to detect recording media jams.

Preferably, the sensors that are used during image formation include at least one sensor selected from the group consisting of (a) a registration sensor which serves to detect the position of recording media positioned by means of a registration roller provided along the recording media conveyance path, and (b) a recording media discharge sensor that serves to detect the discharge state of the recording media and which is provided adjacent to a discharge unit to which the recording media is discharged.

Preferably, a plurality of fixation control sensors are provided; and the sensor power control means controls the power supply to one or more of the plurality of fixation control sensors which have not caused the fixation control means to switch the heating means to the non-fixation operation control state. In addition, the sensor power control means controls the power supply in the same way as with the other sensors that are used during image formation.

Typically, in the non-fixation operation control state, it is often necessary to supply power only to some sensors among the fixation control sensors (those sensors that are used to cancel the non-fixation operation control state). Accordingly, the apparatus according to the present invention achieves more effective energy-saving control by interrupting the power supply to the sensors other than the sensors that need electricity, when it is impossible to perform image formation.

In addition, a storage medium is disclosed that stores a control program for controlling an image forming apparatus comprising a heating means which fixes a toner image formed on a recording medium, and a heating temperature sensor which detects the temperature of the heating means. The control program causes the image forming apparatus to perform:

a fixation control function which switches between (a) a fixation operation control state in which the heating means is controlled such that the temperature detected by the heating temperature sensor is maintained at a temperature needed to fix the toner image to the recording medium, and (b) a non-fixation operation control state different from the fixation operation control state, in accordance with results detected by one or more fixation control sensors; and a sensor power control function which controls power supplied to sensors, other than the one or more fixation control sensors and the heating temperature sensor, that are used during image formation, such that the power supply is interrupted when the heating means is switched to the non-fixation operation control state by the fixation control function, and the power is supplied when the heating means is switched to the fixation operation control state by the fixation control function and the temperature detected by the heating temperature sensor is equal to or greater than a predetermined temperature near the fixation temperature.

According to the present invention, even if the image forming apparatus is switched from the non-fixation operation control state to the fixation operation control state, if the heat source has not achieved the fixation temperature and thus an image cannot be formed, the power is prevented from being supplied to the sensors that are used during image formation, such as the registration sensor and the recording sheet discharge sensor. Consequently, the apparatus according to the present invention achieves more effective energy-saving control compared to the conventional technologies, wherein power is supplied to each of the sensors if the apparatus is switched to the fixation operation control state, regardless of whether or not it is possible to form an image.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Referring to the attached drawings, an embodiment of the present invention will be described hereinafter in order to explain the present invention. Note that the embodiment described below is only one embodiment of the present invention, and does not limit the scope of the present invention.

Figure 1:
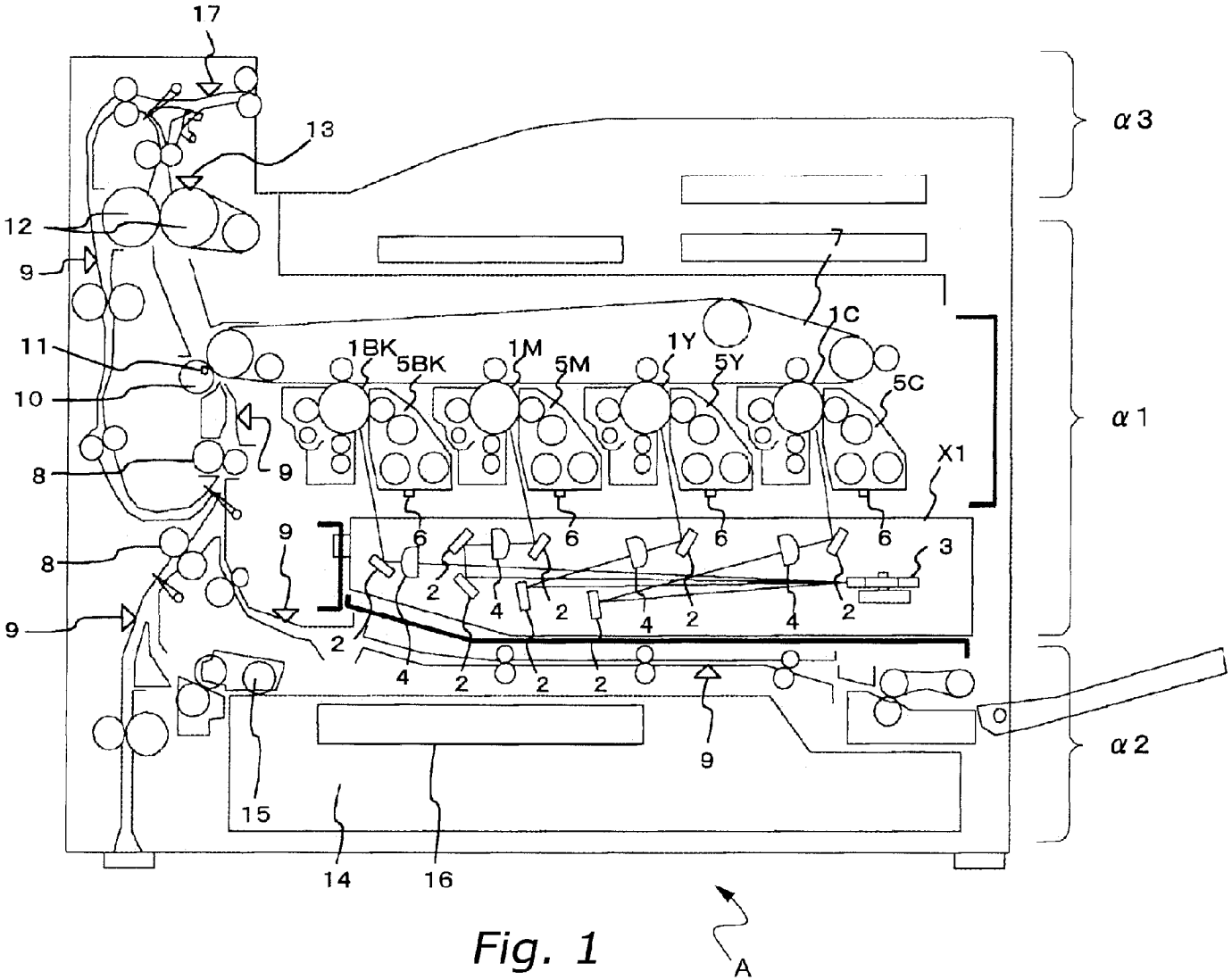
FIG. 1 is a schematic view of a printer according to an embodiment of the present invention.
Figure 2:
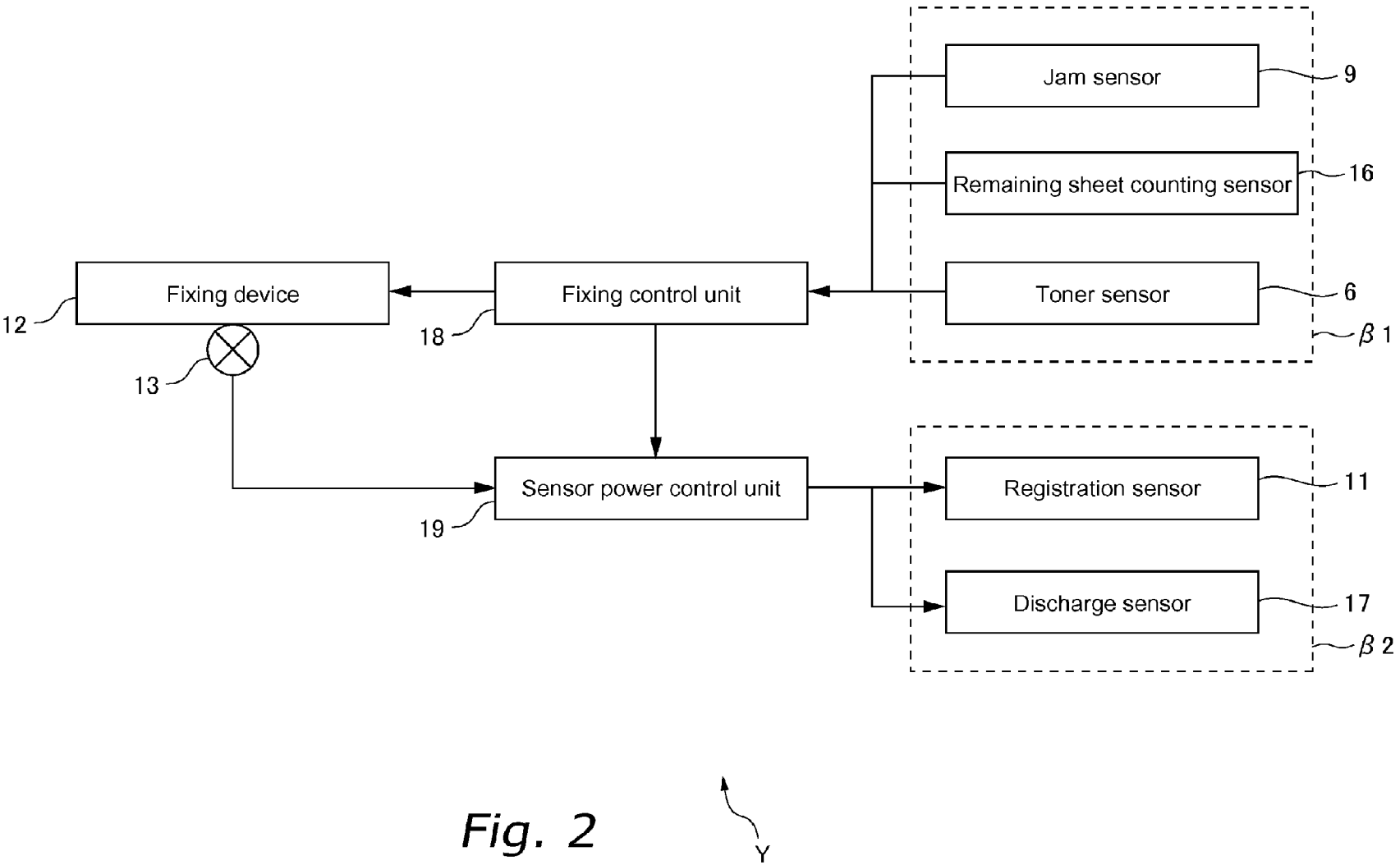
FIG. 2 is a schematic view of a control system that controls the power supply to sensors in the printer according to an embodiment of the present invention.
Figure 3:
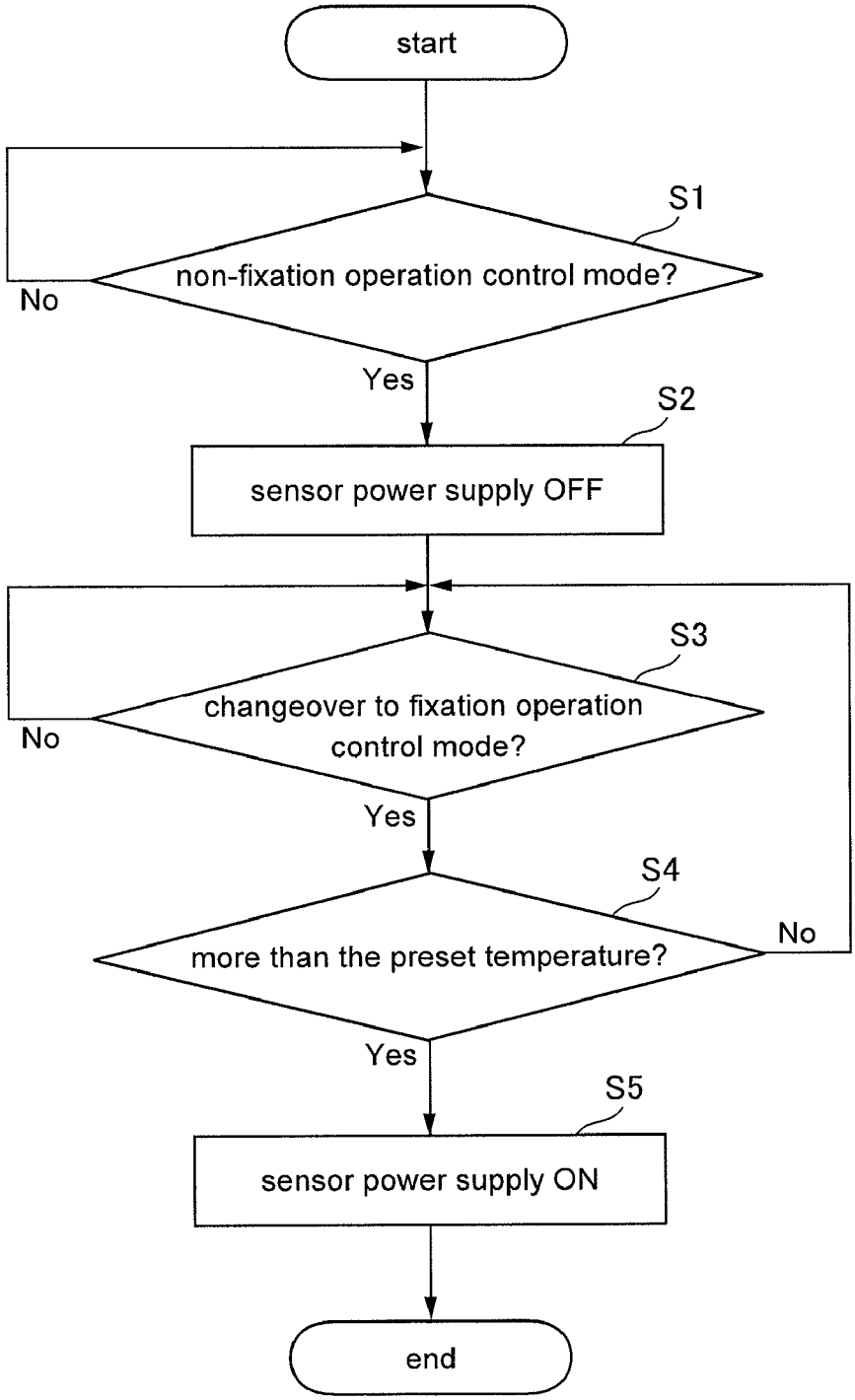
FIG. 3 is a flow chart showing energy-saving control steps performed by the control system in the printer according to an embodiment of the present invention.

FIG. 1 is a schematic, structural view of a printer according to an embodiment of the present invention. FIG. 2 is a schematic, structural view of a control system for controlling power supply to each sensor in the printer according to the embodiment of the present invention. FIG. 3 is a flow chart showing processes of energy-saving control by the control system of the printer according to the embodiment of the present invention.

(1) Schematic Structure of the Printer According to the Embodiment of the Present Invention FIG. 1 a schematic, structural view of a printing unit, a sheet feeding unit, and a discharge unit in a tandem type image forming apparatus, and is preferably a printer that employs four color toners, i.e., black (BK), magenta (M), yellow (Y), and cyan (C).

First, referring to FIG. 1, the schematic structure of the tandem type printer of will be described below.

The printer A shown in FIG. 1 includes a printing unit $\alpha$1 for forming toner images and printing recording sheets, a sheet feeding unit $\alpha$2 for supplying recording sheets to the printing unit $\alpha$1, and a discharge unit $\alpha$3 for discharging the recording sheets after printing. Print request signals representing a print request and image data signals representing image data are input to the printer A from an external device, typically a personal computer, via an external input interface not shown in the drawings. The image data is read by an image process control device (not shown in the drawings) in accordance with the image data signals, and is converted into grayscale data corresponding to each of four colors, black (BK), magenta (M), yellow (Y), and cyan (C).

The printing unit $\alpha$1 is generally composed of photosensitive drums 1BK, 1M, 1Y, and 1C, a light scanning unit X1, developing devices 5BK, 5M, 5Y, and 5C, toner sensors 6, an intermediate transfer belt 7, conveyance rollers 8, jam sensors 9, registration rollers 10, a registration sensor 11, a fixing device 12, and a heating temperature sensor 13.

The image process control device controls, based upon the grayscale data, four beam sources (not shown) that illuminate the photosensitive drums that correspond to the four colors (a photosensitive drum 1BK for black, a photosensitive drum 1M for magenta, a photosensitive drum 1Y for yellow, and a photosensitive drum 1C for cyan), and causes the beam sources to radiate light.

The beams are guided to each of the above-mentioned photosensitive drums through the light scanning unit X1 including a plurality of deflecting mirrors 2, a polygon mirror 3, and fθ lenses 4. As a result, latent images are formed on the surfaces of the photosensitive drums 1BK, 1M, 1Y, and 1C.

Next, the toner on each of the developing rollers of the developing devices 5BK, 5M, 5Y, and 5C corresponding to the photosensitive drums 1BK, 1M, 1Y, and 1C is respectively drawn to the surfaces of the photosensitive drums 1BK, 1M, 1Y, and 1C, so that the latent images are developed into toner images with the toner in accordance with potential differences or developing biases between the photosensitive drum 1BK, 1M, 1Y, and 1 C and the developing rollers, respectively. Note that the remaining amount of the toner in the developing devices 5BK, 5M, 5Y, and 5C is detected by the toner sensors 6, and the result is input to a fixing control unit 18 described later (refer to FIG. 2).

The sheet feeding unit α2 is generally composed of a sheet feeding cassette 14, a feeding roller 15, and a remaining sheet counting sensor 16. The sheet feeding cassette 14 contains recording sheets stacked therein beforehand. In accordance with an image formation request by a user, for example, an image formation request from a personal computer connected to the printer A, the image process control unit controls the feeding roller 15 to rotate so that a recording sheet stacked on the sheet feeding cassette 14 is conveyed to the printing unit α1. The remaining number of recording sheets on the sheet feeding cassette 14 is detected by the remaining sheet counting sensor 16.

After being sent from the sheet feeding unit α2, the recording sheet is conveyed to the registration rollers 10 by the conveyance rollers 8. The recording sheet is temporarily stopped there in order to synchronize with image leading ends of each of the photosensitive drums, and the leading end of the sheet is uniformly inserted into a nip portion of the registration rollers 10 in order to correct the end positions of the recording sheets. The standby state of the recording sheet at the registration rollers 10 is detected by the registration sensor 11, and the result is input to the fixing control unit 18 described later (refer to FIG. 2).

Meanwhile, the toner images formed on the photosensitive drum 1BK, 1M, 1Y, 1C are transferred to the intermediate transfer belt 7, and in turn transferred to the recording sheet that is on standby and inserted into the nip portion of the registration rollers 10, by means of the drive of the intermediate transfer belt 7. Then, after the toner images are transferred, the recording sheet is conveyed to the fixing device 12, and the toner image is fixed to the recording sheet by a heat roller of the fixing device 12. Note that the heating temperature of the fixing device 12, which is the surface temperature of the heat roller supplied by a heat source (not shown) in the fixing device 12, is controlled by the fixing control unit 18 described later (refer to FIG. 2). The temperature of the fixing device 12 is detected by the heating temperature sensor 13, and the result is input to a sensor power control unit 19 described later (refer to FIG. 2).

After the toner image is fixed, the recording sheet is conveyed to the discharge unit α3 and is discharged. The discharge state is detected by the discharge sensor 17 in the discharge unit α3.

(2) Classification of the Sensors in the Printer According to the Embodiment of the Present Invention The sensors (the jam sensor 9, the toner sensors 6, the discharge sensor 17, the registration sensor 11, and the remaining sheet counting sensor 16), except for the above-mentioned heating temperature sensor 13, are classified into two groups. One group is referred to as fixation control sensor group β1, and includes the jam sensor 9 provided along a conveyance path for the recording sheet and which serves to detect a jam of the recording sheets, the toner sensors 6 which serve to detect the remaining amount of toner, and the remaining sheet counting sensor 16 which serves to detect the remaining number of recording sheets. The sensors belonging to fixation control sensor group β1 are utilized in order to determine whether or not the printer A is in a state in which it is possible to perform image formation, as described later.

The other group is referred to as image formation sensor group β2, and includes the registration sensor 11 provided along the conveyance path for the recording sheets and which serve to detect the positioning of a recording sheet positioned by the registration rollers 10, and the discharge sensor 17 located adjacent to a discharge unit to which the recording sheet is discharged out of the printer A and which serves to detect the discharge state of the recording sheets. The sensors belonging to group β2 are utilized during image formation.

(3) General Structure of a Controller that Controls the Power Supply to the Sensors in the Printer According to the Embodiment of the Present Invention FIG. 2 is a schematic, structural view of a control system Y that controls the power supply to the sensors in the printer according to the embodiment of the present invention. Referring to FIG. 2, the functions of each of the components used to control the power supply to the sensors in the printer A will be described hereinafter.

As shown in FIG. 2, the control system Y in the printer A is generally composed of the jam sensor 9, the toner sensor 6, the discharge sensor 17, the registration sensor 11, the remaining sheet counting sensor 16, the fixing device 12, the heating temperature sensor 13, the fixing control unit 18, and the sensor power control unit 19.

As noted above, the results detected by the sensors (the toner sensor 6, the jam sensor 9, the remaining sheet counting sensor 16) belonging to group β1 are input to the fixing control unit 18 shown in FIG. 2. The fixing control unit 18 controls the fixing device 12 in accordance with the results detected by the sensors belonging to group β1.

The fixing device 12 has a heat roller that serves to fix the toner onto the recording sheet, and the surface temperature of the heat roller is detected by the heating temperature sensor 13.

Mode signals that represent identification data for control states (two modes described later) of the fixing device 12 controlled by the fixing control unit 18, and information signals about the surface temperature of the heat roller detected by the heating temperature sensor 13, are input to the sensor power control unit 19 that controls power supply to the sensors belonging to group β2. The sensor power control unit 19 controls the power supply to the sensors (the registration sensor 11 and the discharge sensor 17) belonging to sensor group β2, in accordance with the information signals.

(4) Mode Changeover Function of the Printer A in the Present Embodiment

The printer A has a changeover function between a fixation operation state control mode and a non-fixation operation state control mode described below.

In the fixation state control mode, the fixing control unit 18 controls the fixing device 12 to make it possible to form an image such that the temperature detected by the heating temperature sensor 13 is maintained at the temperature needed to fix the toner, for example, around 200 degrees centigrade. The printer A is set or switched to the fixation state control mode, when the results detected by all of the sensors belonging to group β1 indicate that it is possible to perform image formation (in other words, when the jam sensor 9 does not detect a jam, the remaining sheet counting sensor 16 detects the existence of a remaining amount of recording sheets, and the toner sensor 6 detects a sufficient remaining amount of toner in the developing devices 5), and within a certain time since the last image forming operation, or when the user inputs an image formation request. Note that even if the printer is switched from the non-fixation state control mode to the fixation state control mode, it requires some heating time in order to increase the temperature of the fixing device 12 up to the fixation temperature.

Meanwhile, the non-fixation state control mode means a standby mode in which the fixing control unit 18 controls the fixing device 12 such that the temperature detected by the heating temperature sensor 13 is maintained at a temperature lower than the fixation temperature by a certain temperature, for example, around 150 degrees centigrade.

The printer A is set or switched into the non-fixation state control mode, when the results detected by any of the sensors belonging to group β1 indicate that it is impossible to perform image formation (in other words, the jam sensor 9 detects a jam, the remaining sheet counting sensor 16 does not detect the existence of recording sheets, or the toner sensor 6 detects an insufficient amount of the toner in the developing devices 5, or some time has elapsed since the last image forming operation).

The fixing control unit 18 inputs the mode signal to the sensor power control unit 19, the mode signal that represents identification data whether the printer A is set in the fixation state control mode or in the non-fixation state control mode.

(5) Power Supply Control to the Sensors Belonging to Group β2 in the Printer of According to the Embodiment FIG. 3 is a flow chart showing the energy-saving control steps taken by the control system Y in the printer according to the embodiment of the present invention.

Referring to FIG. 3, power supply control by the control system Y to the sensors (the registration sensor 11 and the discharge sensor 17) belonging to group β2 will be described in detail. Note that the steps in the flow chart shown in FIG. 3 are performed by the sensor power control unit 19 in the control system Y, as later described in detail. S1, S2, S3, S4, and S5 in FIG. 3 represent the numbers of the steps, and steps are repeatedly executed from Step S1 when the printer A is operated.

In Step S1, the sensor power control unit 19 determines whether or not the printer A is set in the non-fixation state control mode, in accordance with the mode signals that are input from the fixing control unit 18.

If it is determined that the printer A is set in the non-fixation state control mode (YES in S1), the process proceeds to Step S2. If it is determined that the printer is set to the fixation state control mode (NO in S1), the process of Step S1 is repeated.

In the process of Step S2, it is determined that the printer A can not form an image, and thus the power supply is interrupted to the sensors (the registration sensor 11 and the discharge sensor 17) belonging to group β2. In other words, by controlling the power source for supplying power to the registration sensor 11, the discharge sensor 17, and a switch circuit (not shown) that is provided in a power supply path to the registration sensor 11 and the discharge sensor 17, the power supply to the registration sensor 11 and the discharge sensor 17 is interrupted. After the process of Step S2, the process proceeds to Step S3.

In the process of Step S3, the sensor power control unit 19 determines whether or not the printer A is switched from the non-fixation state control mode to the fixation state control mode in accordance with the mode signal that is input from the fixing control unit 18. If the non-fixation state control mode continues (NO in S3), the process of Step S3 is repeated. In contrast, if it is determined that the printer is switched from the non-fixation state control mode to the fixation state control mode (YES in S3), the process proceeds to Step S4.

In the process of Step S4, the sensor power control unit 19 determines whether or not the surface temperature of the heat roller in the fixing device 12 is equal to or greater than a predetermined temperature near the fixation temperature, wherein the predetermined temperature is set to about 160 degrees centigrade if the fixing temperature is 200 degrees centigrade, in accordance with the results detected by the heating temperature sensor 13. If it is determined that the temperature is equal to or greater than the predetermined temperature (YES in Step S4) so that it is possible to form an image, the process proceeds to Step S5. In contrast, if it is determined that the temperature is below the predetermined temperature (NO in S4) so that it is impossible to form an image, the process returns to Step S3.

In the process of Step S5, the sensor power control unit 19 starts the power supply to the sensors (the registration sensor 11 and the discharge sensor 17) belonging to group β2. After the process of Step S5, the processes are repeated from Step S1.

It will be appreciated that the printer A according to the present embodiment is characterized by the above-mentioned process in Step S4. In other words, by means of the process in Step S4, unneeded power supply is interrupted to the sensors that are used during image formation, when the heating temperature of the fixing device 12 has not reached the fixing temperature and thus is impossible to form an image, although the printer A is set to the fixation state control mode.

In other words, power is supplied to the sensors only when the printer A is set to the fixation state control mode by the fixing control unit 18, and the detected temperature on the surface of heat roller of the fixing device is equal to or greater than the predetermined temperature.

EXAMPLE

Although in the above-mentioned embodiment the sensor power control unit 19 controls the power supply only to the sensors (the registration sensor 11 and the discharge sensor 17) belonging to group β2, there are other possibilities. In other words, the power supply may be interrupted to some of the sensors belonging to group β1.

In the non-fixation state control mode described above, it is not necessary to supply power to all of the sensors belonging to group β1. For example, if the printer is switched to the non-fixation state control mode by the fixing control unit 18 because a recording sheet jam result detected by the jam sensor 9 is input to the fixing control unit 18, it means that the jam sensor 9 is used to cancel the non-fixation state control mode, i.e., to switch to the fixation state control mode. However, because there is no need to energize the sensors belonging to group β1 except for the jam sensor 9, i.e., the toner sensor 6 and the remaining sheet counting sensor 16, the sensor power control unit 19 may interrupt the power supply to them similar to the sensors belonging to group β2.

As mentioned above, if the sensor power control unit 19 controls the power supply to the sensors belonging to group β1 other than the sensor that has caused the printer to be switched to the non-fixation state control mode, similar to sensor group β2, energy-saving is achieved more effectively.

Although a printer has been described as one example of the image forming apparatus according to the present invention in the above-mentioned embodiment, the present invention is not limited to a printer, and can be applied to a copying machine, a facsimile machine, and to a multiple function device having printer and facsimile functions.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-355317. The entire disclosure of Japanese Patent Application No. 2004-355317 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming apparatus, comprising:

a heating means which fixes a toner image formed on a recording medium;

a heating temperature sensor which detects the temperature of the heating means;

a fixation control means which switches between (a) a fixation operation control state in which the heating means is controlled such that the temperature detected by the heating temperature sensor is maintained at a temperature needed to fix the toner image to the recording medium, and (b) a non-fixation operation control state different from the fixation operation control state, in accordance with results detected by one or more fixation control sensors; and a sensor power control means which controls power supplied to sensors, other than the one or more fixation control sensors and the heating temperature sensor, that are used during image formation, such that the power supply is interrupted when the heating means is switched to the non-fixation operation control state by the fixation control means, and the power is supplied when the heating means is switched to the fixation operation control state by the fixation control means and the temperature detected by the heating temperature sensor is equal to or greater than a predetermined temperature near the fixation temperature.

2. An image forming apparatus according to claim 1, wherein the one or more fixation control sensors include at least one sensor selected from the group consisting of (a) a sensor for detecting the amount toner remaining, (b) a sensor for detecting the number of recording media remaining, and (c) a recording media jam sensor provided along a recording media conveyance path which serves to detect recording media jams.

3. An image forming apparatus according to claim 1, wherein the sensors that are used during image formation include at least one sensor selected from the group consisting of (a) a registration sensor which serves to detect the position of recording media positioned by means of a registration roller provided along the recording media conveyance path, and (b) a recording media discharge sensor that serves to detect the discharge state of the recording media and which is provided adjacent to a discharge unit to which the recording media is discharged.

4. An image forming apparatus according to claim 1, wherein a plurality of fixation control sensors are provided, and the sensor power control means controls the power supply to one or more of the plurality of fixation control sensors which have not caused the fixation control means to switch the heating means to the non-fixation operation control state, the sensor power control means controlling the power supply in the same way as with the other sensors that are used during image formation.

5. A storage medium that stores a control program for controlling an image forming apparatus comprising a heating means which fixes a toner image formed on a recording medium, and a heating temperature sensor which detects the temperature of the heating means; the control program causing the image forming apparatus to perform:

a fixation control function which switches between (a) a fixation operation control state in which the heating means is controlled such that the temperature detected by the heating temperature sensor is maintained at a temperature needed to fix the toner image to the recording medium, and (b) a non-fixation operation control state different from the fixation operation control state, in accordance with results detected by one or more fixation control sensors; and a sensor power control function which controls power supplied to sensors, other than the one or more fixation control sensors and the heating temperature sensor, that are used during image formation, such that the power supply is interrupted when the heating means is switched to the non-fixation operation control state by the fixation control function, and the power is supplied when the heating means is switched to the fixation operation control state by the fixation control function and the temperature detected by the heating temperature sensor is equal to or greater than a predetermined temperature near the fixation temperature.

* * * * *